United States Patent [19]

Ward et al.

[11] 4,107,004

[45] Aug. 15, 1978

[54] TRIVALENT CHROMIUM ELECTROPLATING BATHS AND METHOD

[75] Inventors: John Joseph Bernard Ward; Clive Barnes, both of Wantage, England

[73] Assignee: International Lead Zinc Research Organization, Inc., New York, N.Y.

[21] Appl. No.: 853,326

[22] Filed: Nov. 21, 1977

Related U.S. Application Data

[63] Continuation-in-part of Ser. No. 668,443, Mar. 19, 1976, abandoned.

[30] Foreign Application Priority Data

Mar. 26, 1975 [GB] United Kingdom ..... 12776/75

[51] Int. Cl.[2] ..... C25D 3/06

[52] U.S. Cl. ..... 204/51

[58] Field of Search ..... 204/51, 43 R, 105 R, 204/123

[56] References Cited

U.S. PATENT DOCUMENTS 3,917,517 11/1975 Jordan et al. ..... 204/51 X 3,954,574 5/1976 Gyllenspetz et al. ..... 204/51 X

FOREIGN PATENT DOCUMENTS 219,356 8/1968 U.S.S.R. ..... 204/43 R

OTHER PUBLICATIONS

Larissa Domnikov, Metal Finishing, pp. 107–109, Jun. 1966.

*Primary Examiner*—G. L. Kaplan

*Attorney, Agent, or Firm*—Brumbaugh, Graves, Donohue & Raymond

[57] ABSTRACT

An aqueous trivalent chromium plating bath having low temperature stability comprising trivalent chromium ions preferably in a concentration of at least 0.2 M, sulphate ions preferably in a concentration of at least 0.3 M, a weak complexing agent for the chromium ions in a concentration of at least 0.1 M, and fluoride ions in a concentration of at least 0.025 M. The bath preferably also contains chloride ions in a concentration of at least 0.1 M.

9 Claims, No Drawings

TRIVALENT CHROMIUM ELECTROPLATING BATHS AND METHOD

This application is a continuation-in-part of application Ser. No. 668,443, filed Mar. 19, 1976 and now abandoned.

The present invention relates to trivalent chromium plating baths and in particular to plating baths containing weak complexing agents such as hypophosphite and glycine.

It is known to electroplate chromium from aqueous baths containing trivalent chromium ions and an organic buffer, perferably an aprotic buffer such as dimethylformamide (DMF). Such techniques are described in British Patent Specification No. 1144913. In electroplating from electrolytes buffered with e.g. DMF, it is advantageous to ensure, as far as possible, that the electrolyte has a single anion, usually sulphate or chloride. It is preferred not to use mixed anion electrolytes (see in this regard British Patent Specification Nos. 1,194,913 and 1,333,714). More recently a variety of trivalent chromium electrolytes have been developed which use weak complexing agents instead of or, optionally but not usually preferably, with an organic buffer. Typical weak complexing agents are hypophosphite, usually as the sodium salt, glycine and mixtures of these. Such systems are described in U.S. Pat. No. 3,917,517 which is incorporated herein by reference. The term "weak complexing agent for trivalent chromium ions" is used and defined herein as meaning a complexing agent for trivalent chromium ions which does not bind trivalent chromium so strongly as to prevent electrodeposition of chromium from aqueous trivalent chromium solutions containing it.

One advantage of electrolytes using weak complexing agents is that they are more tolerant towards mixed anions than electrolytes using organic buffers such as DMF. However, electrolytes using weak complexing agents based on sulphate as the anion, have a disadvantage in that if the electrolyte is cooled it deteriorates and bath constituents can crystallize out.

Once they have crystallized out these materials are difficult to get back into solution and it may be necessary to heat the electrolyte well above its normal operating temperature to complete re-dissolution. In the laboratory this is a minor inconvenience, but in large scale plant operation such cooling, which can easily occur when the electrolyte is not in use such as overnight or over a weekend, particularly when the weather is cool, can precipitate sufficient material that the delay and expenditure of energy necessary to re-dissolve the materials may make such electrolytes uneconomic to operate despite their other advantages.

It is an object of the present invention to improve the low temperature stability of sulphate based trivalent chromium electrolytes.

The present invention accordingly provides an aqueous trivalent chromium plating bath electrolyte based on sulphate as anion which comprises:

Trivalent chromium ions in a concentration of at least 0.2 molar, sulphate ions in a concentration of at least 0.3 molar, a weak complexing agent for trivalent chromium ions in a concentration of at least 0.1 molar, and fluoride ions in a concentration of at least 0.025 molar.

The concentration of trivalent chromium ions above 0.2 molar is typical of trivalent chromium baths but is usually limited to a maximum of 2 molar by the solubility of chromic sulphate. For decorative plating the optimum concentration is about 1 molar.

The minimum concentration of sulphate ions given is a practical minimum figure corresponding to the minimum level of trivalent chromium. The preferred range is from 1 to 6 molar optimally from 2 to 4 molar.

The particular concentration and precise nature of the weak complexing agent are not critical to the useful effect of fluoride ions in sulphate based electrolytes. Hypophosphite and/or glycine are the preferred weak complexing agents and will typically be used in a concentration of from 0.1 to 6 molar preferably 0.25 to 3 molar, the upper limit being largely a function of solubility. Glycine is additionally advantageous, because the chromium deposit usually has a lighter color.

The concentration of fluoride must be at least 0.025 molar in order to obtain any appreciable effect. The maximum concentration is limited by solubility and diminishing returns to 1.5 molar. Preferably the concentration is up to 1.25 molar, optimally from 0.1 to 0.7 molar. Conveniently the fluoride can be added as sodium fluoride and the minimum level corresponds to about 1 $gl^{-1}$ of NaF and the optimum from about 5 to 25 $gl^{-1}$. Other fluoride containing salts and materials can be used as fluoride ion sources.

In order to ensure a relatively high electrolyte conductivity it is preferred to include ammonium ion in the electrolyte. When used the concentration of ammonium ion will typically be from 1 to 7 molar and preferably greater than 5 M for optimum effect. The ammonium ion can conveniently be added as the sulphate (but see below concerning mixed sulphate/chloride systems). The electrolyte may optionally include a variety of other materials such as are typically used in trivalent chromium electrolytes. For example, boric acid can be included as a current efficiency enhencing agent at concentrations up to saturation (about 1 molar) typically at 20 to 60 $gl^{-1}$.

Unlike certain known trivalent chromium electrolytes, e.g. such as are disclosed in U.S. Pat. No. 3,954,574, bromide is not an essential ingredient and in fact it is preferred that the electrolyte according to the invention be bromide-free.

The effect of adding fluoride to chromic sulphate baths is to impair the production of particles of difficultly electroreducible chromium complexes which tend to form at low temperature. Fluoride ion has the ability to break up those moieties enabling the optimum equilibrium to be satisfied more readily. The baths of the invention typically operate at temperatures from ambient temperature to 50° C and preferably from 25° to 35° C. Restarting plating then only requires warming to operating temperature - extensive warming at elevated temperatures being unnecessary. In similar baths not containing fluoride it would probably be necessary to heat the bath at a relatively high temperature, typically 50° C or higher, for a prolonged period to achieve dissolution of the precipitate.

A further effect of fluoride is that it acts as a plating exhaltant. The average plating efficiency of a fluoride containing, sulphate based trivalent chromium plating bath can be double that of a similar bath without the fluoride. A further advantage is that the color of the chromium deposited, which in trivalent chromium systems tends to be rather dark, is lighter when deposited in the presence of fluoride and more nearly matches the color of plate produced from hexavalent chromium plating baths.

As is indicated above fluoride ion can be included in mixed sulphate/chloride baths. The inclusion of chloride is sulphate trivalent chromium baths is itself, advantageous, but the effect of chloride on its own is less than the effect of fluoride. The concentration of chloride ion, when present, is at least 0.1 molar and will usually be in the range 0.1 to 5.0 molar preferably 0.5 to 5.0 molar. The molar ratio of chloride to sulphate in such baths should be in the range 1:60 to 5:1. The chloride ion can conveniently be added as ammonium chloride.

The plating range of an optimised fluoride containing sulphate based bath is typically from 30 to $10^4$ $Am^{-2}$. However in commercial plant operations the range is somewhat narrower and is typically 50 to $10^4$ $Am^{-2}$. Thus, fluoride acts to reduce the loss of efficiency of sulphate based baths at low current densities. Because of the increased efficiency given to trivalent chromium plating baths the average rate of plating from baths of the invention can be as high as 0.15 $\mu$ $min^{-1}$. Higher rates of deposition can be achieved by raising the temperature or reducing the pH.

In addition to the electrolyte described above the invention also includes a method of electroplating comprising providing an anode and a cathode in an electrolyte of the invention and passing an electric current through the electrolyte whereby chromium is electrodeposited on the cathode.

The method of the invention can be carried out at a pH of from 0.5 to 7. However, in order to maintain a wide plating range the preferred pH is from 1.5 to 4. The make-up pH of an electrolyte comprising the necessary components as a solution of the stoichiometrically neutral salts in water is usually within this range. However the pH can be readily adjusted by adding suitable small quantities of acid or alkali as necessary.

The electrolyte may be made up by a pH changing technique which can ensure formation of the desired complex between the trivalent chromium and the weak complexing agent.

The anodes used in the process of the invention are not critical to the process of the invention. Carbon anodes will in general by used because of their cheapness and convenience.

The following Examples illustrate the invention:

EXAMPLE 1

An aqueous electrolyte was made up having the following composition:

1 molar trivalent chromium (as sulphate)
4 molar $NH_4^+$ (as sulphate)
1 molar boric acid
1 molar sodium hypophosphite A Hull Cell panel was plated for 60 seconds under the following conditions:

pH 3.0 Hull Cell current 10A
Temperature 25° C Hull Cell voltage 16V

The results were as follows:

| Current Density ($Am^{-2}$) | 300 | 600 | 1000 | 3000 | 5000 |
|---|---|---|---|---|---|
| Thickness ($\mu m$) | 0.06 | 0.08 | 0.07 | 0.08 | 0.06 |

EXAMPLE 2

Example 1 was repeated except that 6 M $NH_4^+$ ion was provided as a mixture of the sulphate (3 M) and the chloride (3 M). The Hull Cell panel results were:

| Current Density ($Am^{-2}$) | 300 | 500 | 1000 | 3000 | 5000 |
|---|---|---|---|---|---|
| Thickness ($\mu m$) | 0.07 | 0.08 | 0.09 | 0.10 | 0.10 |

EXAMPLE 3

Example 1 was repeated except that 20 $gl^{-1}$ (ca 0.5 M) sodium fluoride was included in the electrolyte. The Hull Cell panel results were:

| Current Density ($Am^{-2}$) | 300 | 500 | 1000 | 2500 | 5000 |
|---|---|---|---|---|---|
| Thickness ($\mu m$) | 0.10 | 0.14 | 0.14 | 0.13 | 0.15 |

There was a marked exhaltation of plating rate in the presence of the fluoride.

EXAMPLE 4

Example 2 was repeated except that 20 $gl^{-1}$ NaF was included in the electrolyte. The Hull Cell panel results were:

| Current Density ($Am^{-2}$) | 300 | 600 | 1000 | 3000 | 5000 |
|---|---|---|---|---|---|
| Thickness ($\mu m$) | 0.12 | 0.14 | 0.15 | 0.14 | 0.14 |

Again there was a significant improvement in the plating rate.

EXAMPLE 5

An aqueous electrolyte was made up having the following composition:

1 Molar trivalent chromium (as sulphate)
4 Molar $NH_4^+$ (as sulphate)
1 Molar boric acid
1 Molar glycine A Hull Cell panel was pated for 60 seconds under the following condition:

| | |
|---|---|
| pH 2.8 | Hull Cell Current 10A |
| Temp. 25° C | Hull Cell Voltage 16V |

The results were as follows:

| Current Density ($Am^{-2}$) | 300 | 600 | 1000 | 2500 | 4500 |
|---|---|---|---|---|---|
| Thickness ($\mu m$) | 0.02 | 0.08 | 0.10 | 0.14 | 0.16 |

EXAMPLE 6

Example 5 was repeated except that the 4 M $NH_4^+$ ion was provided as a mixture of the sulphate (3 M) and the chloride (1 M) and that 20 $gl^{-1}$ NaF was included. The results was as follows:

| Current Density ($Am^{-2}$) | 300 | 500 | 1000 | 2500 | 5000 |
|---|---|---|---|---|---|
| Thickness ($\mu m$) | 0.05 | 0.10 | 0.11 | 0.15 | 0.16 |

EXAMPLE 7

The following aqueous electrolyte was made up:

| | |
|---|---|
| 1 Molar trivalent chromium | (as sulphate) |
| 3 Molar $NH_4^+$ | (as sulphate) |
| 1 Molar $NH_4^+$ | (as chloride) |
| 1 Molar boric acid | |

0.5 Molar glycine
0.6 M sodium hypophosphite
20 g/l sodium fluoride

A Hull Cell panel was plated for 60 seconds under the following conditions:

| | |
|---|---|
| pH 2.75<br>Temp. 26° C | Hull Cell Current 10A<br>Hull Cell Voltage i0V |

The results were as follows:

| Current Density ($Am^{-2}$) | 300 | 500 | 1000 | 2500 | 5000 |
|---|---|---|---|---|---|
| Thickness (μm) | 0.07 | 0.12 | 0.12 | 0.16 | 0.15 |

EXAMPLE 8

Chromium was plated from a solution comprised of:

| | |
|---|---|
| Chrome tan | 260 g/l |
| Ammonium sulphate | 180 g/l |
| Ammonium chloride | 150 g/l |
| Sodium fluoride | 15 g/l |
| Boric acid | 40 g/l |
| Sodium hypophosphite | 100 g/l |

This solution showed good Hull Cell characteristics and was ultimately shown to work well on the gallon and sixty gallon scale. The color of the chromium deposit was slightly darker than that achieved with conventional hexavalent chromium solutions but gave the impression of increased color depth and was considered to be attractive.

The throwing power was significantly improved and high current density burning was substantially eliminated since the plate rate was more or less constant regardless of the current density applied.

We claim:

1. A trivalent aqueous chromium plating solution comprising trivalent chromium ions in a concentration of at least 0.2 M, sulphate ions in a concentration of at least 0.3 M, a weak complexing agent for said trivalent chromium ions in a concentration of at least 0.1 M and selected from the group consisting of hypophosphite ions and glycine, fluoride ions in a concentration of at least 0.025 M, and chloride ions in a concentration of at least 0.1 M.

2. A trivalent chromium plating solution according to claim 1 wherein the weak complexing agent is in a concentration of from 0.25 to 3 M.

3. A trivalent chromium plating solution according to claim 2 containing ammonium ions in a concentration of from 1 to 7 M.

4. A trivalent chromium plating solution according to claim 3 containing ammonium ions in a concentration of at least 5 M.

5. A trivalent chromium plating solution according to claim 1 which contains additionally boric acid.

6. A trivalent chromium plating solution according to claim 1 which contains chloride ions in a concentration of from 0.1 to 5.0 M.

7. A trivalent chromium plating solution according to claim 6 containing chloride ions in a concentration of from 0.5 to 5.0 M, the molar ratio of chloride to sulphate being from 1:60 to 5:1.

8. A trivalent chromium plating solution according to claim 6 wherein said solution is substantially bromide-free.

9. A method for electrodepositing chromium on a substrate which comprises immersing said substrate as the cathode in an aqueous electrolyte solution comprising water, trivalent chromium ions in a concentration of at least 0.2 M, sulphate ions in a concentration of from 1 to 6 M, a weak complexing agent for said trivalent chromium ions in a concentration of at least 0.1 M and selected from the group consisting of hypophosphite ions and glycine, fluoride ions in a concentration of at least 0.025 and chloride ions in a concentration of at least 0.1 M, and passing an electric current through said solution thereby to deposit said trivalent chromium ions on said substrate.

* * * * *

UNITED STATES PATENT AND TRADEMARK OFFICE

CERTIFICATE OF CORRECTION

PATENT NO. : 4,107,004

DATED : August 15, 1978

INVENTOR(S) : John Joseph Bernard Ward and Clive Barnes

It is certified that error appears in the above-identified patent and that said Letters Patent are hereby corrected as shown below:

Column 3, line 3, "is" (first occurrence) should be --in--; line 20, "μ" should be --μm--. Column 4, line 54, "was" should be --were--; line 67, remove line indicating end of listing. Column 5, first 3 lines, these three items should appear in the same small type as the previous four items, with a line below them to indicate the end of the listing; line 8, "iOV" should be --10V--.

Signed and Sealed this

*Third* Day of *April 1979*

[SEAL]

*Attest:*

RUTH C. MASON
*Attesting Officer*

DONALD W. BANNER
*Commissioner of Patents and Trademarks*